US006499206B1

(12) United States Patent
Eure et al.

(10) Patent No.: US 6,499,206 B1
(45) Date of Patent: Dec. 31, 2002

(54) APPARATUS AND METHOD FOR MANUFACTURING PALLETS

(76) Inventors: Karl Matthew Eure, Rte. 6, Box 153, Hertford, NC (US) 27944; Robert Maryland Wiggins, P.O. Box 116, Belvidere, NC (US) 27919; Burt Anthony Eure, Rte. 6, Box 152, Hertford, NC (US) 27944

( * ) Notice: Subject to any disclaimer, the term of this patent is extended or adjusted under 35 U.S.C. 154(b) by 0 days.

(21) Appl. No.: 09/572,875

(22) Filed: May 18, 2000

(51) Int. Cl.[7] ..... B21D 39/03

(52) U.S. Cl. ..... 29/430; 29/432; 29/281.4; 227/110

(58) Field of Search ..... 29/430, 432, 281.1, 29/281.4, 281.5, 559; 227/110

(56) References Cited

U.S. PATENT DOCUMENTS

| | | | | |
|---|---|---|---|---|
| 3,231,101 | A | | 1/1966 | Cooper |
| 3,557,439 | A | | 1/1971 | Dykeman |
| 3,751,794 | A | * | 8/1973 | Kay |
| 4,077,106 | A | | 3/1978 | Lichtenstein et al. |
| 4,403,388 | A | * | 9/1983 | Belcher |
| 4,492,016 | A | | 1/1985 | Smets et al. |
| 4,757,605 | A | | 7/1988 | Richardelli |
| 4,793,540 | A | * | 12/1988 | Mangan |
| 4,824,004 | A | | 4/1989 | Hanson |
| 4,829,651 | A | * | 5/1989 | Shirai |
| 4,998,336 | A | * | 3/1991 | Papsdorf |
| 5,058,795 | A | | 10/1991 | Tonus |
| 5,234,204 | A | * | 8/1993 | Hunt |
| 5,249,352 | A | | 10/1993 | Landers |
| 5,355,575 | A | | 10/1994 | Self |
| 5,457,869 | A | | 10/1995 | Doyle |
| 5,555,617 | A | | 9/1996 | Pope |
| 5,725,205 | A | * | 3/1998 | O'Berg |
| 5,918,358 | A | * | 7/1999 | Ffield |

* cited by examiner

*Primary Examiner*—David P. Bryant
*Assistant Examiner*—Steven Blount
(74) *Attorney, Agent, or Firm*—Summa & Allan, P.A.

(57) ABSTRACT

Disclosed is an apparatus and method for manufacturing pallets. The apparatus and method incorporates an assembly table that alternates between an inclined position where the components of the pallet are fastened and a lower, horizontal position where the assembled pallet is transferred to an conveyor.

22 Claims, 4 Drawing Sheets

SWITCH #2

APPARATUS AND METHOD FOR MANUFACTURING PALLETS

FIELD OF THE INVENTION

The present invention relates to the manufacture of pallets. In particular, the invention relates to an automated apparatus and method for manufacturing pallets from wooden boards in a safe and efficient manner.

BACKGROUND

Pallets, particularly wooden pallets, are an indispensable part of industrial and commercial shipping, handling and storage of goods. Pallets are typically formed of a number of spaced, parallel boards or "stringers" connected by a number of spaced, parallel deck boards that are situated perpendicular to the stringers. A pallet has at least one deck in which deck boards are attached (e.g., nailed) to one side of the stringers. As used herein the term pallet means a set of stringers having at least one deck. More commonly, deck boards are attached to both sides of the stringers thereby creating a two-deck pallet. The apparatus and method according to the invention includes the manufacture of both single and double deck pallets.

The demand for pallets is never ceasing. This demand is responsible for the development of several machines and methods for automating and increasing the efficiency of pallet manufacture. The majority of these devices fall into two types: large, expensive machines that require substantial space and capital or smaller machines that are not operator friendly or require unnecessary manual labor. U.S. Pat. No. 3,557,439 to Dykeman is an example of the former and U.S. Pat. No. 4,077,106 is an example of the latter. Furthermore, many of the known devices utilize designs that add unnecessary safety risks to the operator such as arms that can fall on an operator's hands as in U.S. Pat. No. 5,355,575 to Self or free-falling pallets as in U.S. Pat. Nos. 4,492,016 to Smets et al and 5,058,795 to Tonus.

Accordingly, a need exists for a pallet manufacturing machine that is compact, economical, efficient and operator friendly. Preferably, the machine requires only one operator and minimizes the physical labor required by the operator. Additionally, the machine should minimize the safety risks to the operator by channeling movement of the pallet away from the operator rather than towards the operator or perpendicular to the operator.

OBJECT AND SUMMARY OF THE INVENTION

Therefore, an object of the invention is to provide an apparatus and method for efficiently, quickly and safely manufacturing pallets. A further object of the invention is to provide an apparatus and method for manufacturing pallets that is economical in terms of capital investment and manpower. These and additional objects are met by the apparatus and method of the claimed invention.

A preferred embodiment of the invention comprises an apparatus for manufacturing pallets comprising an assembly table. The assembly table comprises means for supporting a plurality of stringers situated in a common plane. The apparatus further comprises means for arranging a plurality of deck boards transversely across the stringers and means for fastening the deck boards to the stringers to form a pallet. The apparatus also comprises a transitioning means for lowering the assembly table from an inclined position to a substantially horizontal position where the pallet engages with a conveyor which transfers the pallet to subsequent processing stations.

A further embodiment of the invention is a method for manufacturing pallets. The method according to the invention comprises positioning a plurality of stringers on an inclined assembly table and traversing the stringers with a first plurality of deck boards. The deck boards are then fastened (i.e., nailed) to the stringers to form a pallet. The assembly table is then lowered from an inclined position to a substantially horizontal position whereby the pallet engages with a conveyor. The pallet is then transferred from the horizontally positioned assembly table to subsequent processing stations.

The foregoing and other objects and advantages of the invention and the manner in which the same are accomplished will become clearer based on the following detailed description taken in conjunction with the accompanying drawings in which:

DETAILED DESCRIPTION OF THE PREFERRED EMBODIMENTS

Figure 1:
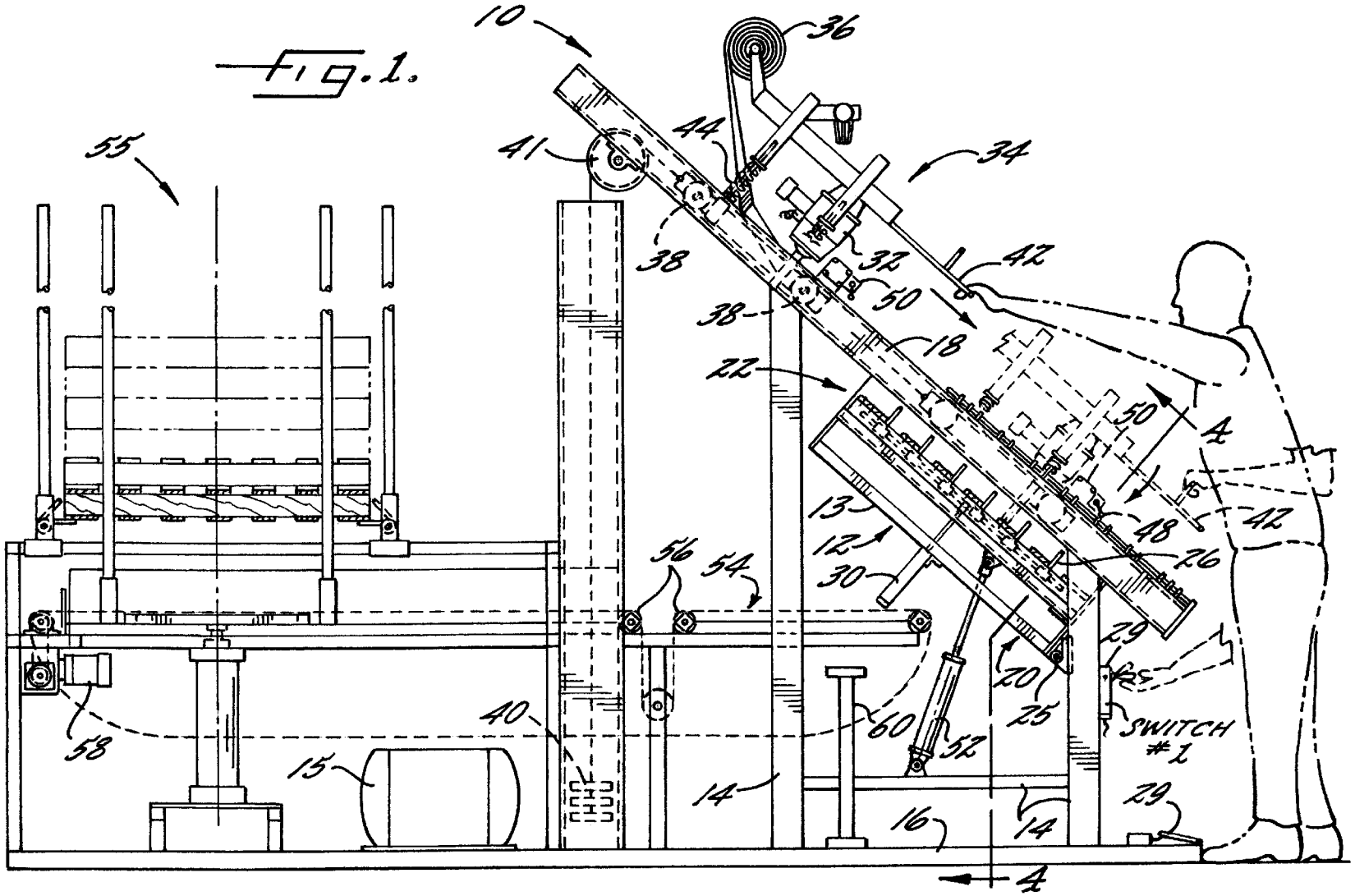
FIG. 1 is a side view of one embodiment of the apparatus according to the invention.
Figure 1A:
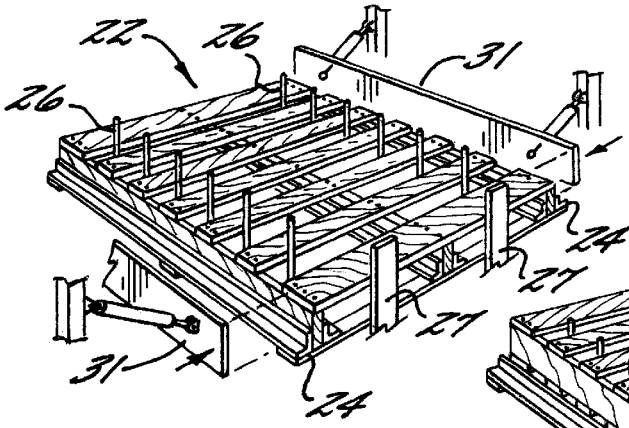
FIG. 1A is a perspective view of an assembly table and a single deck pallet.
Figure 3:
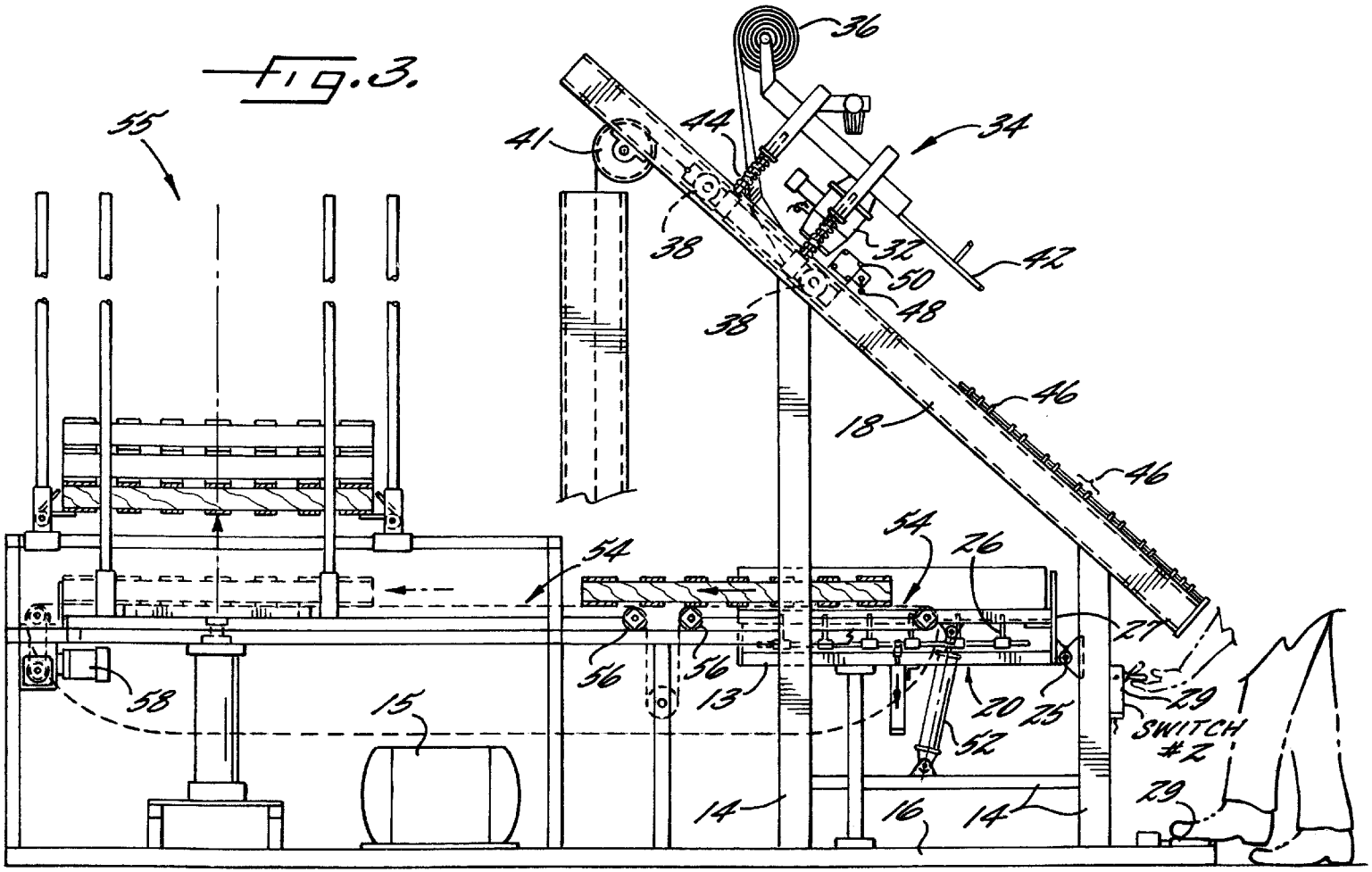
FIG. 3 is a side view of the apparatus of FIG. 1 in which a completed pallet is removed from the assembly table.
Figure 4:
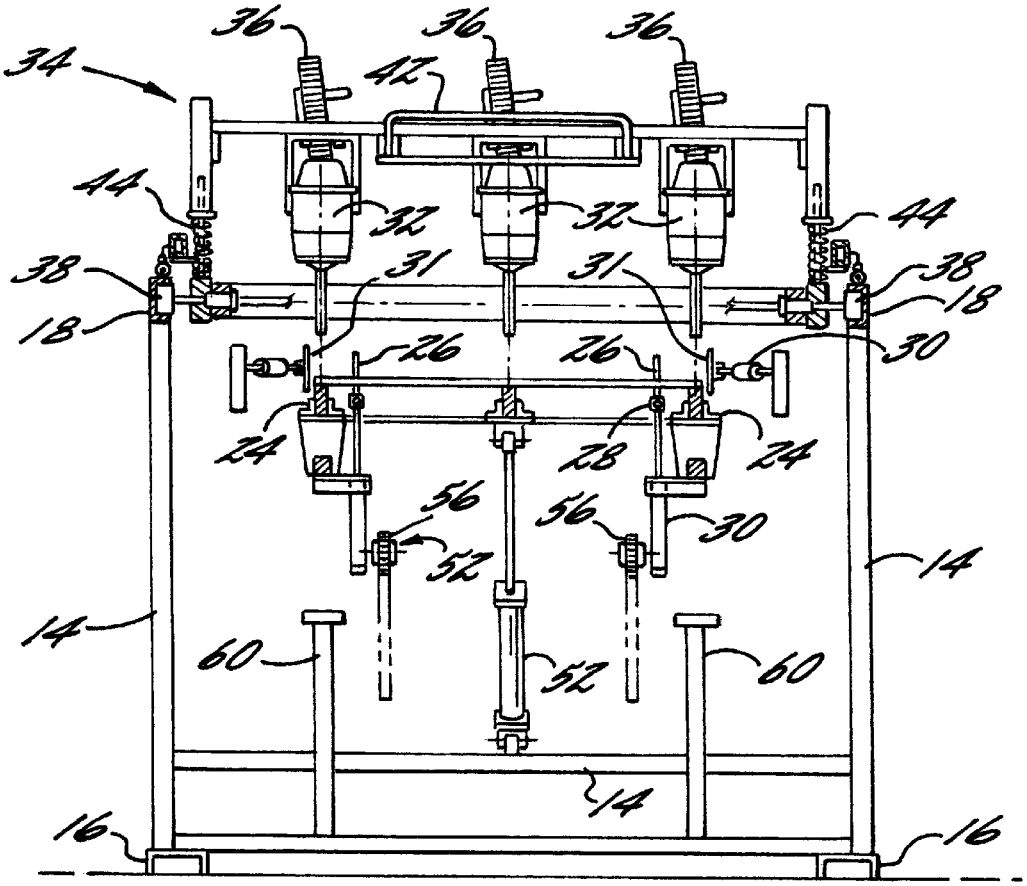
FIG. 4 is a cross-sectional view of the apparatus of FIG. 2 taken along line 4—4.

The invention is an apparatus and method for assembling pallets. Referring now to FIGS. 1 and 1A, a preferred embodiment of the apparatus according to the invention is broadly designated at 10. The apparatus comprises an assembly table 12 and a generally rectangular frame formed of vertical and horizontal beams 14 and a platform 16 as shown in FIGS. 1 and 4. Two parallel inclined beams 18 complete the frame as shown in FIGS. 1 and 3. The inclined beams 18 should be such that they are capable of providing a means of transit for a movable gantry as discussed in greater detail below.

The assembly table 12 is generally rectangular in shape and possesses a proximate end 20 and a distal end 22 in relation to the operator as shown in FIG. 1. The assembly table 12 comprises means for supporting a plurality of stringers situated in a common plane. In a preferred embodiment, the means for supporting the plurality of stringers consists of at least two and preferably three jigs 24 as shown in FIGS. 1A and 4. The jigs 24 are attached to a supporting structure 13 which forms a portion of the table 12. The jigs 24 are substantially parallel and extend between the proximate end 20 and the distal end 22 of the assembly table 12. The jigs 24 receive stringers and securely hold them in place as shown in FIG. 1A.

Preferably the jigs 24 are movably attached to the supporting structure 13 such that they may be adjusted to manufacture pallets of varying width. For example, the jigs 24 may slide along the width of supporting structure 13 and lock into place using clamps or holes and pins or any other appropriate securing means.

The supporting structure 13 is pivotally attached to the frame at a pivot point 25 toward the proximate end 20 of the assembly table 12. The supporting structure 13 and thus the assembly table 12 alternate between an inclined position (as shown in FIG. 1) and a substantially horizontal position (as shown in FIG. 3) by pivoting about pivot point 25.

Figure 2:
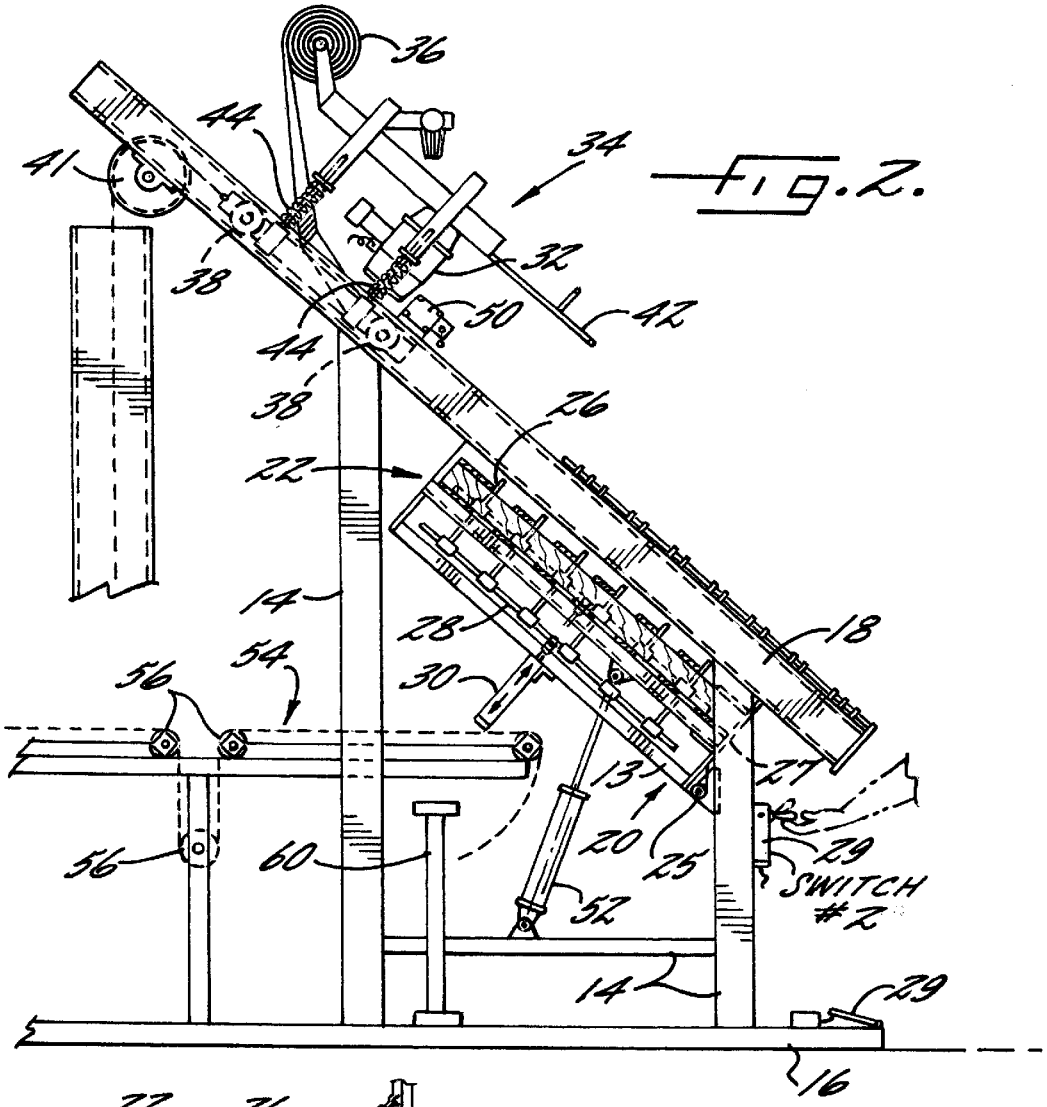
FIG. 2 is a side view of one embodiment of the apparatus according to the invention.

Referring now to FIGS. 2.2 and 3, a transitioning means 52 lowers the assembly table 12 from an inclined position in which the distant end of the table is approximately 45° from the horizontal to a substantially horizontal position upon completion of a pallet. The transitioning means 52 may be any device capable of raising and lowering the assembly table 12. Suitable means include hydraulic cylinders, electric motors and pneumatic cylinders. Preferably the transitioning means 52 is a pneumatic cylinder.

Throughout this description various means for moving or changing the position of different elements are described. Those skilled in the art recognize that any appropriate means, such as hydraulic or electric means may be utilized in the practice of the invention without requiring undue experimentation. For purposes of this discussion, however, the apparatus according to the invention will utilize pneumatic means operated by a compressor 15 and control devices such as air manifolds, air lines and switches that are not shown in detail but are well-known to those skilled in the art. For example, all pneumatic devices described herein may be activated by individual hand or foot switches schematically represented in the Figures at 29. The precise control mechanism utilized by the invention is not critical to the successful practice of the invention and is not addressed further.

The apparatus also comprises means for arranging a plurality of deck boards transversely across the stringers. Preferably, the means for arranging comprises a plurality of reciprocating fingers 26 positioned intermediate the stringers as shown in FIG. 1A. The fingers 26 are arranged in at least two linear rows along the length of the stringers. Each row of fingers 26 has an equal number of fingers 26 thereby establishing a fixed set of paired fingers.

Figure 2A:
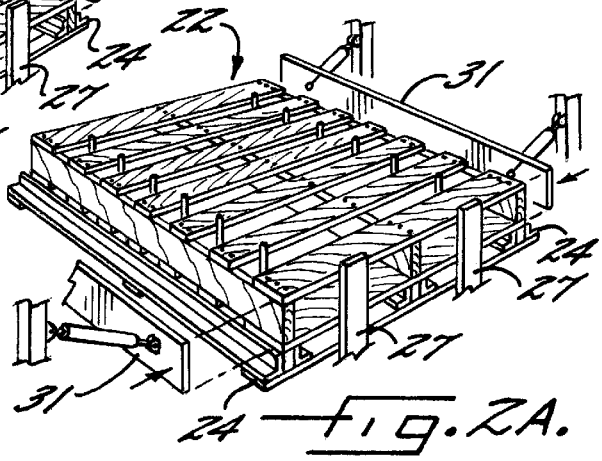
FIG. 2A is a perspective view of an assembly table and a double deck pallet.

Each row of fingers 26 is attached to a reciprocating arm 28 as shown in FIGS. 2 and 4. Each finger 26 possess a length sufficient to traverse the height of the stringers and thereby protrude above the stringers as shown in FIG. 1A. The reciprocating arm 28 reciprocates between a retracted position where the distal ends of the fingers 26 are below the stringers and an extended position where the distal ends of the fingers 26 are above the stringers. FIGS 1A, 2A and 4 show the finger 26 in an extended position. FIG. 3 shows the fingers 26 in a retracted position. Each set of paired fingers 26 acts as a support structure for a deck board when in the extended position. The final or bottom deck board is held in place by non-reciprocating fingers 27 as shown in FIGS. 1A and 2A. Pneumatic cylinders 30 retract and extend the reciprocating arms 28. As mentioned previously, the operator activates the pneumatic cylinders 30 by means of a hand or foot switch 29.

The apparatus further comprises one or more compressing means that straightens, aligns and assists in holding the deck boards in place on the assembly table 12. Representative compressing means are shown in FIGS. 1A, 2A and 4 as movable side pieces 31. Additional pneumatic cylinders 30 reciprocate the movable side pieces 31 between an expanded and retracted position. The movable side pieces 31 are retracted during placement of the stringers and deck boards. After the deck boards are placed, the side pieces 31 are expanded to compress the outer edges of the deck boards thereby aligning them and holding them in place for fastening.

Referring now to FIG. 4, the apparatus according to the invention further comprises means for fastening the deck boards to the stringers to form a pallet. In a preferred embodiment the means for fastening comprises a plurality of nail guns 32 mounted on a movable gantry 34. The nail guns 32 may be of any type but are preferably of the pneumatic type which are commercially available in hardware stores and home improvement stores. Pneumatic guns are preferred because they may be easily integrated into the pneumatic system controlling other aspects of the apparatus. The movable gantry 34 also supports a supply of nails 36 for each gun and the means for powering the guns (typically electric switches and pneumatic lines not shown). the nail guns 32 are horizontally aligned across the gantry 34 such that at least one nail gun is aligned along the length of each of the stringers as shown in FIG. 4. Typically this requires that the gantry 34 support at least three nail guns 32.

The movable gantry 34 is supported by and moves along the inclined beams 18 using a traditional wheel and channel system such as the system commonly used in overhead cranes. A set of guide wheels 38 attached to the gantry 34 travel in channels formed within or on the inclined beams 18. Preferably, the gantry 34 is counterbalanced by a pulley 41 and weight system 40 that aid the operator in moving the gantry 34 as shown in FIG. 1. A handle 42 allows the operator to move the gantry 34 along the inclined beams 18.

The gantry 34 further comprises a height adjusting means 44. The height adjusting means may be any structure, such as a pneumatic or hydraulic cylinder or spring, that allows for vertical movement upon the application and release of downward pressure upon handle 42. The embodiments shown in FIGS. 1 and 3 incorporate springs. The springs 44 allow the operator to adjust the height of the nail guns 32 as the guns pass over the stringers and deck boards. Such adjustment is needed when double decked pallets are built.

Building double deck pallets requires the inversion of single deck pallets on the assembly table prior to aligning the second set of deck boards as shown in FIG. 2A. Upon inversion, the pallet is no longer held in place by the stringers in the jigs 24. Instead, the first set of deck boards rest on top of the jigs 24 thereby raising the overall height of the pallet in relation to the nail guns 32. While inverted, the pallet is held in place by the fingers 26 and non-reciprocating fingers 27.

The springs 44 allow the operator to lower the nail guns 32 when the first deck is nailed and raise the guns when the second deck is nailed. The raising and lowering of the nail guns 32 is shown in FIGS. 1 and 3. In FIG. 1, the operator applies a downward force on handle 42 when the gantry 34 is positioned over the assembly table 12. The force is represented by the downward arrow and compressed springs in FIG. 1. The springs are relaxed when the nail guns 32 are returned to their starting position or when nailing a second deck of boards. The height adjusting means also functions as part of the automatic nailing mechanism which is discussed below.

The gantry 34 carrying the nail guns 32 traverses the length of the stringers nailing the deck boards to the stringers. The firing of the nail guns 32 may occur either automatically or manually. The apparatus is provided with an automatic triggering mechanism if automatic operation is desired. The automatic triggering mechanism comprises a plurality of raised protrusions 46 positioned along the inclined beam 18. The raised protrusions 46 are best illustrated in FIGS. 1 and 3. The plurality of raised protrusions 46 are placed to coincide with the intersection of the stringers and the deck boards situated on the assembly table 12. As the gantry 34 and nail guns 32 move down the inclined beams 18, the operator presses on the handle 42 which compresses the springs 44 and brings a smaller lever 48 into close contact with the inclined beam 18 and the raised protrusions 46. As shown in FIG. 1, the lever 48 engages wit the raised protrusions 46 as the gantry 34 travels down the inclined beam. The lever 48 is connected to an electrical switch 50 that triggers the firing of the nail guns 32 as the nail guns 32 pass over the raised protrusions. The operator raises the gantry 34 upon completion of the nailing, which disengages the triggering mechanism and returns the gantry 34 to its starting position at the top of the inclined beams 18. Alternatively, the operator can turn off the automatic firing mechanism by bypassing the electrical switch 50 connected to the lever 48. In this event, the operator activates a trigger (not shown) attached to the handle 42 thereby firing the nail guns 32.

The apparatus further comprises a conveyor 54 for transferring a completed pallet from the assembly table 12 to subsequently processing points. The subsequent processing point represented in the Figures consists of a stacker 55 of a type that is commercially available. The conveyor 54 may be any type of commercial conveyor suitable for use with heavy and rough materials. The embodiment shown in FIGS. 3 and 3A utilizes a two armed conveyor comprising two synchronized endless chains running in parallel that are driven by two sets of drive sockets 56 as shown in FIGS. 2, 3, 3A and 4.

The transfer of a pallet from the assembly table 12 to the conveyor 54 is a function of the design of the assembly table 12 and the conveyor 54. The transitioning means 52, pivot point 25, supporting structure 13 and the attached jigs 24 are designed to allow the assembly table 12 to rotate in a controlled manner from an inclined position to a lower substantially horizontal position. Vertical stops 60 shown in FIG. 4 may be utilized to support the assembly table 12 while it is in a horizontal position. The rotation takes the pallet downward and away from the operator thereby reducing the risk that the operator will be injured by mechanical failure of the assembly table 12, transitioning means 52 or conveyor 54. Upon failure of any of these components the pallet simply falls away from the operator rather than towards the operator.

Figure 3A:
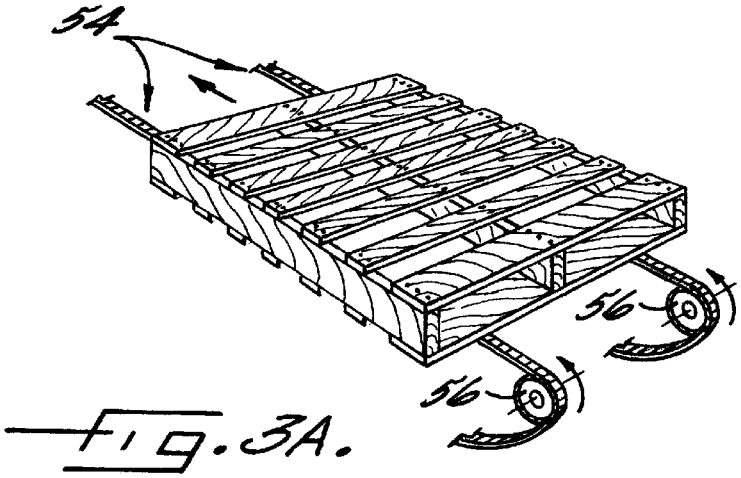
FIG. 3A is a perspective view of a pallet traveling on a conveyor.

The assembly table 12, more specifically the supporting structure 13 and the attached jigs 24, are designed to provide an opening for the parallel arms of the conveyor 54 that allows the assembly table 12 to rotate to a position where the top of the jibs 24 are at least co-planar with the conveyor 54 thereby allowing the pallet to come into contact with the conveyor 54 as shown in FIGS. 3 and 3A. In a preferred embodiment, the switch activating the motor 58 for the conveyor 54 is paired with the switch that lowers and raises the assembly table 12 thereby accomplishing both the transfer of a completed pallet and the staging for a new pallet in a single step.

The invention also encompasses a method for the manufacture of pallets. The method comprises positioning a plurality of stringers on an inclined assembly table 12. The step of positioning the stringers preferably comprises securing at least two stringers in at least two substantially parallel and spaced apart jigs 24.

The stringers are then traversed with a plurality of deck boards. In a preferred embodiment, the step of traversing the stringers with deck boards is accomplished utilizing a plurality of reciprocating fingers positioned intermediate the stringers. The stringers reciprocate between a retracted position where the distal ends of the fingers are below the stringers and an extended position where the distal ends are above the stringers and hereby forming supports for the deck boards traversing the stringers.

The operator then moves the gantry 34 and the battery of nail guns 32 along the inclined beam 18 in a plane that is parallel to the plane of the inclined assembly table 12. If the operator chooses automatic operation, the operator applies sufficient pressure to the handle 42 of the gantry 34 to compress the height adjusting means 44 and the lower the nail guns 32 to a position to ensure engagement of the triggering lever 48 with the raised protrusions 46. Alternatively, the operator may bypass or disengage the automatic nailing feature of the apparatus and manually fire the nail guns 32 using triggers located on the handle 42. In either instance, the nail guns 32 fire as the nail guns pass the intersections of the stringers and the deck boards.

If single deck pallets are desired, the assembly table 12 is then lowered until the pallet engages with the conveyor 54. The conveyor 54 transfers the single deck pallet to subsequent processing points.

If a double deck pallet is desired, the single deck pallet is inverted on the assembly table 12. Typically the reciprocating fingers 26 are retracted prior to inverting the pallet and extended after inverting the pallet. A second set of deck boards is then nailed to the stringers in the manner described above.

The operator lowers the assembly table 12 after the nailing of the second set of deck boards. The assembly table 12 is lowered until the pallet engages with the conveyor 54. The conveyor 54 transports the pallet to subsequent processing points.

The invention has been described in detail, with reference to certain preferred embodiments, in order to enable the reader to practice the invention without undue experimentation. However, a person having ordinary skill in the art will readily recognize that many of the components an parameters may be varied or modified to a certain extent without departing from the scope and spirit of the invention. Furthermore, titles, headings, or the like are provided to enhance the reader's comprehension of this document, and should not be read as limiting the scope of the present invention. Accordingly, only the following claims and reasonable extensions and equivalents define the intellectual property rights to the invention.

That which is claimed is:

1. An apparatus for manufacturing pallets comprising:

an assembly table having a proximate end and a distal end, said assembly table being vertically pivotable about a pivot point situated toward the proximate end;

means for raising and lowering said distal end of said assembly table between a horizontal plane and an inclined position in which the assembly table forms an acute angle in conjunction with the horizontal plane;

means for supporting on said assembly table a plurality of stringers situated in a common plane;

a plurality of reciprocating fingers positioned intermediate said stringers, said plurality of fingers possessing means for reciprocating between a retracted position where the distal ends of said fingers are below said stringers and an extended position where the distal ends of said fingers are above said stringers; and a plurality of nail guns carried by a movable gantry, said gantry having a direction of movement above and substantially parallel to said assembly table when said distal end of said table is raised in an inclined position; and a conveyor for conveying a completed pallet from the distal end of said assembly table when said table is in a generally horizontal position.

2. An apparatus according to claim 1 wherein said means for raising and lowering comprises means selected from the group consisting of pneumatic cylinders and hydraulic cylinders.

3. An apparatus according to claim 1 wherein said nail guns are aligned such that at least one nail gun is aligned along the length of each of said stringers.

4. An apparatus according to claim 3 further comprising a manual trigger for manually firing said plurality of nail guns as they pass the intersections of said stringers and said deck boards.

5. An apparatus according to claim 3 further comprising an automatic firing mechanism for automatically firing said plurality of nail guns as they pass the intersections of said stringers and said deck boards.

6. An apparatus according to claim 1 wherein said plurality of fingers are arranged in at least two linear rows along the length of said stringers, each row having an equal number of fingers thereby establishing a fixed set of paired fingers with each set of paired fingers forming a support for a deck board.

7. An apparatus according to claim 1 wherein said gantry possesses height adjusting means for allowing movement of said nail guns between an upper and lower position.

8. An apparatus according to claim 7 wherein said height adjusting means is selected from the group comprising springs, pneumatic cylinders and hydraulic cylinders.

9. An apparatus according to claim 1 wherein said means for supporting said stringers comprises at least two jigs.

10. An apparatus according to claim 1 wherein said automatic firing mechanism comprises a plurality of raised protrusion coinciding with the intersection of the stringers and deck boards and a lever that engages with said raised protrusions thereby triggering the firing of said nail guns.

11. A method for manufacturing pallets comprising:

positioning a plurality of stringers on an assembly table having a proximate and distal end where the distal end is elevated to place the assembly table in an inclined position;

traversing the stringers with a first plurality of deck boards;

fastening the first plurality of deck boards to the stringers to form a pallet while the assembly table, deck boards, and stringers remain in an inclined position;

lowering the assembly table from an inclined position to a substantially horizontal position from which a completed pallet can be conveyed; and conveying the pallet from the distal end of the horizontally positioned assembly table to subsequent processing stations.

12. A method according to claim 11 wherein said step of positioning a plurality of stringers on an inclined assembly table further comprises securing at least two stringers in substantially parallel jigs.

13. A method according to claim 11 wherein the step of traversing the stringers further comprises reciprocating a plurality of fingers positioned intermediate the stringers between a retracted position where the distal ends of the fingers are below the stringers and an extended position where the distal ends of the fingers are above the stringers thereby forming supports which aid in traversing the stringers with the deck boards.

14. A method according to claim 11 wherein the step of lowering the assembly table is accomplished by lowering means selected from the group consisting of pneumatic and hydraulic cylinders.

15. A method according to claim 11 wherein the step of fastening the deck boards is accomplished by a movable gantry supporting a plurality of nail guns wherein at least one nail gun is aligned along the length of each stringer.

16. A method according to claim 15 wherein said nail guns fire automatically at the intersections of the stringers and the deck boards.

17. A method according to claim 15 wherein said nail guns are manually fired at the intersections of the stringers and the deck boards.

18. A method according to claim 11 further comprising:

inverting the pallet after fastening the first plurality of deck boards;

maintaining the pallet in an inclined position;

traversing the stringers with a second plurality of deck boards; and fastening the second plurality of deck boards to the stringers to form a double decked pallet prior to the step of lowering the assembly table.

19. A method for manufacturing pallets comprising:

elevating the distal end of an assembly table having proximate and distal ends and three substantially parallel and spaced apart jigs so that the assembly table is in an inclined position;

placing a stringer into each of the three jigs;

extending two sets of reciprocating fingers between the stringers until the distal end of the reciprocating fingers extends above the stringers, each set of reciprocating fingers having the same number of fingers, the fingers being linearly arranged to form a fixed set of paired fingers that are substantially co-planar in a plane that is perpendicular to the stringers;

traversing the stringers with a first plurality of deck boards supported by the paired fingers;

aligning a plurality of nail guns supported on a movable gantry such that at least one nail gun is aligned along the length of each of the three stringers;

moving the gantry along a plane that is parallel to the plane of the inclined assembly table;

firing the nail guns as the nail guns cross the intersections of the stringers and the first plurality of deck boards to form a pallet having a first deck;

retracting the reciprocating fingers until the distal ends of the fingers are below the stringers;

inverting the pallet on the assembly table and fastening a second plurality of dock boards to form a second deck on the pallet;

extending the reciprocating fingers until the distal end of the reciprocating fingers extends above the stringers;

traversing the stringers with a second plurality of deck boards supported by the reciprocating fingers;

moving the gantry along a plane that is parallel to the plane of the inclined assembly table;

firing the nail guns as the nail guns cross the intersections of the stringers and the second plurality of deck boards to form a pallet having a first and second deck;

retracting the reciprocating fingers until the distal ends of the fingers are below the stringers;

lowering the inclined assembly table to a substantially horizontal position;

conveying the pallet on a conveyor from the distal end of the assembly table to a subsequent processing point.

20. A method according to claim 19 wherein the step of lowering the assembly table is accomplished by lowering means selected from the group consisting of pneumatic and hydraulic cylinders.

21. A method according to claim 19 wherein said nail guns fire automatically at the intersections of the stringers and the deck boards.

22. A method according to claim 19 wherein said nail guns are manually fired at the intersections of the stringers and the deck boards.

* * * * *